US005545866A

United States Patent [19]

Bulin et al.

[11] Patent Number: 5,545,866

[45] Date of Patent: Aug. 13, 1996

[54] NON-STICK PAINTED PUSHBUTTON ASSEMBLY

[75] Inventors: David S. Bulin, Greentown; Michael E. Fye, Kokomo; Rick Stratman, Greentown, all of Ind.

[73] Assignee: Delco Electronics Corp., Kokomo, Ind.

[21] Appl. No.: 414,830

[22] Filed: Mar. 31, 1995

[51] Int. Cl.[6] ..... H01H 13/70

[52] U.S. Cl. ..... 200/345; 200/341

[58] Field of Search ..... 200/345, 344, 200/341, 520, 512, 513, 514, 515, 516, 517, 296, 302.1, 521, 522, 523, 524, 525, 526, 528, 5 A

[56] References Cited

U.S. PATENT DOCUMENTS

| | | | |
|---|---|---|---|
| 2,788,407 | 4/1957 | Brown | 200/520 |
| 3,676,615 | 7/1972 | Wiedmer | 200/517 |
| 3,886,341 | 5/1975 | Forrest | 200/516 |
| 4,152,564 | 5/1979 | Wirz | 200/345 |
| 4,355,211 | 10/1982 | Steiner | 200/345 |

*Primary Examiner*—David J. Walczak
*Attorney, Agent, or Firm*—Jimmy L. Funke

[57] ABSTRACT

A pushbutton for an automotive control panel has a button portion extending through a hole in a trim plate and an enlarged skirt portion behind the plate, and is spring loaded to push the skirt against the rear surface of the plate. A ledge surrounding the button opposes the rear surface. The pushbutton is painted and paint on the ledge causes the skirt to stick to the rear surface of the plate. To prevent sticking, pointed spacers are molded on the ledge so that only the spacer points engage the plate. Sticking from paint adhesion is minimized due to the small amount of paint on the spacer points. Alternatively, the pointed spacers are formed on the rear surface of the plate.

8 Claims, 2 Drawing Sheets

NON-STICK PAINTED PUSHBUTTON ASSEMBLY

FIELD OF THE INVENTION

This invention relates to pushbutton control panels and particularly to painted pushbuttons in such controls with provision to prevent or minimize sticking.

BACKGROUND OF THE INVENTION

It is commonplace to manufacture pushbuttons for automotive controls with symbols or legends by painting the pushbutton and selectively removing a patterned portion of the paint by a laser. The resulting product is called a "paint and laser pushbutton". Such a pushbutton is particularly desirable when the button is made of translucent material and the control panel is backlighted to light up the pattern.

When a control panel comprises a plastic trim plate with apertures and pushbuttons loaded into the apertures, there is generally little, if any, contact between the painted sides of the pushbuttons and the trim plate apertures. However for buttons loaded from the back side of the trim plate, a rear portion of the pushbutton is made larger than the button which protrudes through the aperture and defines a ledge surrounding the button which abuts the rear face of the trim plate. In the process of painting the pushbutton, often with more than one coat of paint, the ledge also becomes painted. Because the ledge is painted, there is a tendency for the pushbutton to adhere to the plastic trim plate. This is particularly significant when the part is exposed to high temperature and humidity, and is further exacerbated with contact time and preload forces. Most types of paints used to coat plastics for automotive interior application exhibit the tendency to stick.

The obvious solutions to the sticking problem are to mask the part to prevent painting of the ledge or the remove the paint after painting. Both of these solutions are difficult and expensive. The ledge itself is necessary to retain the pushbutton in the panel and to prevent light leakage around the pushbutton; thus removal or severe reduction of the ledge is not desirable. The preload force is necessary to prevent looseness and rattling of the pushbutton.

SUMMARY OF THE INVENTION

It is therefore an object of the invention to reduce or eliminate sticking in painted pushbutton controls while maintaining the advantages of prior design parameters.

A pushbutton has a button portion which protrudes through an aperture of a control panel or trim plate, and a larger rear skirt portion which defines a flange or ledge around the button and which is too large to fit through the aperture. Thus the ledge is adjacent the rear surface of the panel. A few pointed projections formed on the ledge contact the rear surface of the panel to thereby space the ledge surface from the panel. The pushbutton, including the ledge, is painted and the desired symbol is inscribed on the front of the button by laser action.

The pointed projection on the ledge are very small, yet are large enough to project above the surface of the ledge a distance greater than the thickness of the paint coating on the surface of the ledge, and thereby serve as a spacer, keeping the paint on the ledge from the panel rear surface. Moreover, the projections are sharp enough that only very little paint film thickness can form, and thus there is a small amount of paint to act as an adhesive.

Alternatively, the standard pushbutton may be used if the pointed spacers are formed on the rear surface of the trim plate instead of on the pushbutton, so that a similar function is carried out. In either case, very little contact of a painted surface with another surface is allowed, and sticking is eliminated or minimized to a level which is not noticeable.

DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
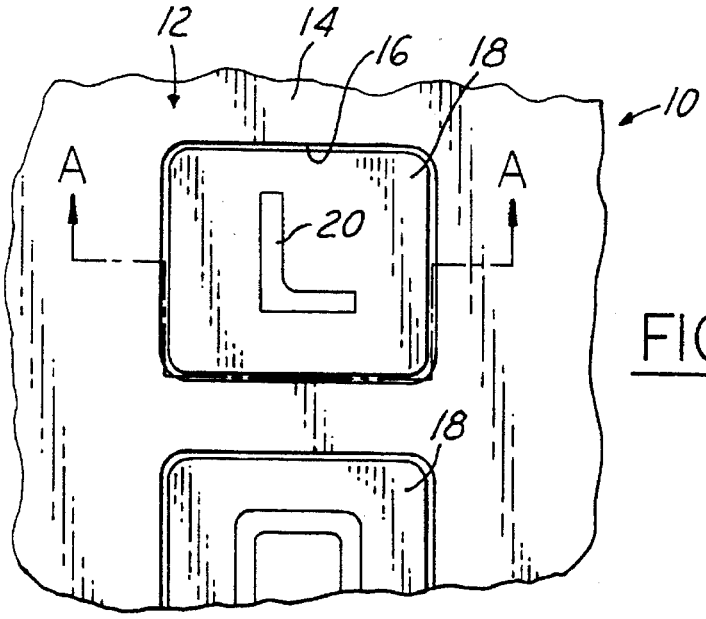
FIG. 1 is a front view of a pushbutton assembly.

Referring to FIG. 1, a portion of an automotive control panel 10 comprises a trim plate 12 having a front face 14 and apertures 16 for pushbuttons 18. The push buttons are coated with paint and a legend or pattern 20 is formed on the front end of the pushbutton by a laser operation which selectively removes paint. Such an arrangement and process are well known, and a typical pushbutton assembly, shown in cross-section in FIG. 2, includes guide walls 22 extending back from the rear face 24 of the plate 12, the walls being set back from the boundary of the apertures 16 to define a small overhang 26. The pushbutton 18 itself comprises a button 28 which protrudes through the aperture 16 and a larger skirt 30 which defines a ledge or flange 32 around the base of the button 28. The skirt loosely fits within the guide walls 22 and slides along the walls when the button 28 is depressed or released. A spring, not shown, exerts a preload force on the pushbutton 18 to hold it secure in its normal position and prevents rattling. The preload force causes engagement of the ledge 32 and the overhang 26 of the plate rear face. This intimate contact of the painted ledge and the rear face of the plate leads to sticking, particularly when exposed to high temperature and humidity for a long time.

Figure 2:
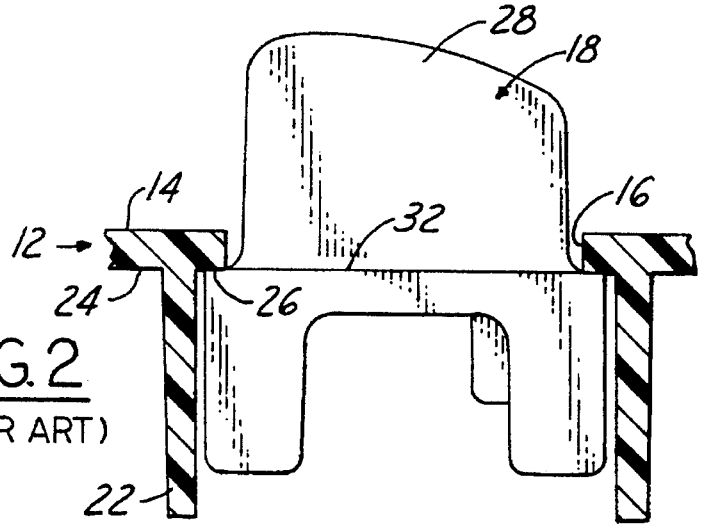
FIG. 2 (PRIOR ART)
FIG. 2 is a cross-section of the assembly of FIG. 1 including a pushbutton configured according to the prior art.
Figure 3:
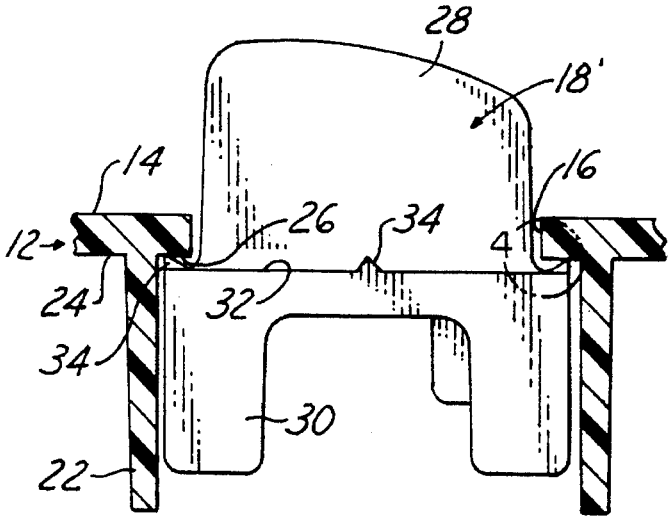
FIG. 3 is a cross-section of the assembly of FIG. 1 including a pushbutton configured according to the invention.
Figure 4:
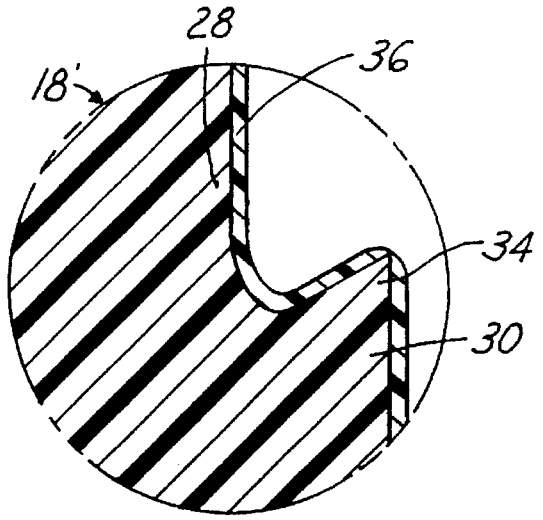
FIG. 4 is an enlarged view of a circled portion of the pushbutton of FIG. 3.
Figure 5:
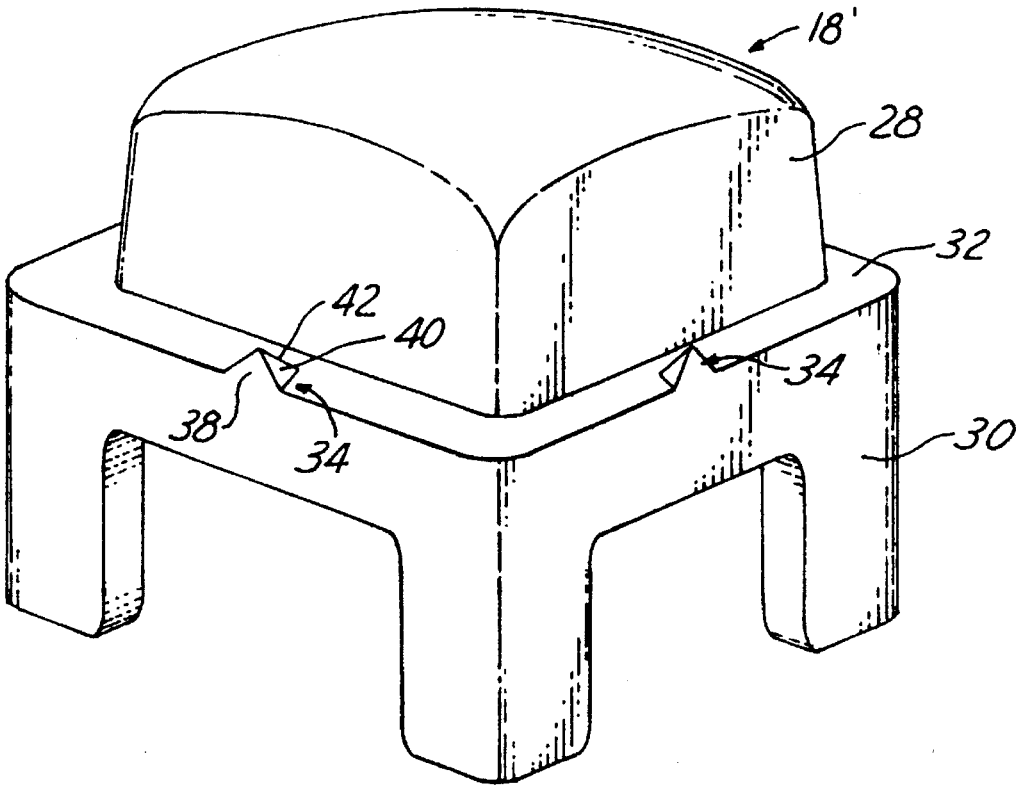
FIG. 5 is an isometric view of the pushbutton of FIG. 3 according to the invention.

The improved pushbutton 18' shown in FIG. 3 is the same as that of FIG. 2 except that it has a provision to space the ledge 32 from the overhang 26. In particular, a few pointed spacers 34 molded on the pushbutton ledge 32 project above the surface of the ledge 32 a distance greater than the thickness of the paint film 36 on the surface of the ledge 32, so as to contact the overhang 26 and thereby prevent the surrounding surface of the painted ledge 32 from engaging the overhang 26. Only the spacers 34 make such contact and, due to the sharp points, the area of contact of each spacer 34 is limited to a single point contact, as shown in FIG. 5. Moreover, due to the sharp points, only a very thin film 36 of paint can form on the ends of the spacers, as shown in cross section in FIG. 4, thereby further reducing the amount of paint which could cause adhesion. The spacers 34 may be of any pointed configuration such as conical or pyramidal.

As best shown in FIG. 5 of the drawings, each spacer 34 has an outer wall 38 in the plane of the skirt 30 and two inclined walls 40 meeting in an apex. The wall 38 has angled sides at an angle of 45° to the surface of the ledge and the two walls 40 meet at a line 42 which also makes an angle of 45° to the surface of the ledge. Thus the spacer has a broad base integral with the ledge and projects forward to the rear face of the panel. The height of the spacer is, for example, 0.5 mm, or greater than the thickness of the paint film. Thus the spacers are effective to separate the paint film from the overhang 26 on the rear face 24 of the plate 12.

Figure 6:
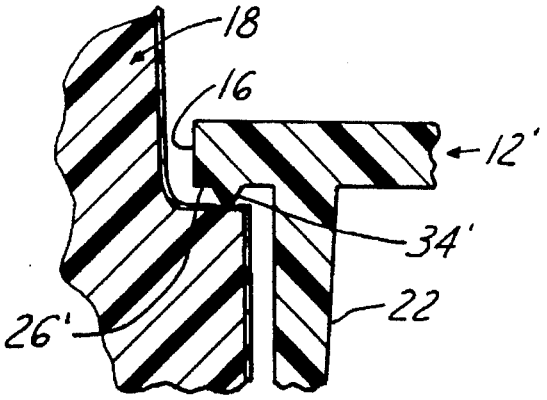
FIG. 6 is a view of a portion of a pushbutton assembly according to a second embodiment of the invention.

It will be recognized that the concept of using the sharp spacers to prevent the painted ledge from sticking to the plate 12 can be extended to other configurations. In particular, the spacers may be molded on the plate instead of on the pushbutton as shown in FIG. 6. The plate 12' has a guide wall 22 which defines a stop surface 26' in the margin around each aperture 16. A plurality of points 34' molded in the plate 12' extend from broad bases in the stop surface 26' to points which engage the ledge 32 of the pushbutton 18.

It will thus be seen that sticking of paint and laser pushbuttons due to paint adhesion is prevented or at least minimized to an amount too small to be noticeable to the user. No extra processing is added to the manufacture of the buttons and the trim plates or their assembly, and the cost of the control panel is not increased.

The embodiments of the invention in which an exclusive property or privilege is claimed are defined as follows:

1. A control panel and pushbutton assembly comprising:

a panel having a surface and an aperture defined by a boundary;

a pushbutton having a button portion extending through the aperture and a peripheral ledge projecting in an outboard direction beyond the boundary of the aperture, the ledge having a surface adjacent to the surface of the panel;

a film of paint on the pushbutton and on the surface of the ledge; and a plurality of spacers between the surface of the ledge and the surface of the panel, the plurality of spacers being configured such that each spacer permits only single point contact between the surface of the ledge and the surface of the panel, whereby the plurality of spacers minimize contact of the film of paint with the surface of the panel.

2. The invention as defined in claim 1 wherein the plurality of spacers comprise contact points integral with at least one of the surfaces formed by the panel and the ledge.

3. The invention as defined in claim 1 wherein the plurality of spacers are integral with the ledge of the pushbutton and project toward and engage the surface of the panel.

4. The invention as defined in claim 3 wherein the plurality of spacers project above the surface of the ledge a distance greater than a thickness of the film of paint on the surface of the ledge.

5. The invention as defined in claim 4 wherein each of the plurality of spacers comprises a wide base on the surface of the ledge, sloped sides, and a sharp point.

6. The invention as defined in claim 4 wherein each of the plurality of spacers is pyramidal having a base on the surface of the ledge, and a sharp point.

7. A control panel and pushbutton assembly comprising;

a panel having front and rear faces and a plurality of apertures, each of the apertures being defined by a boundary;

a guide wall outboard of each boundary and projecting from the rear face of the panel, a portion of the rear face inboard of the guide wall defining a stop;

a painted pushbutton associated with each of the apertures, each of the painted pushbuttons having a skirt slidably disposed within a corresponding guide wall, a button slidably disposed in a corresponding aperture, and a ledge defined between the skirt and the button and opposite a corresponding stop;

wherein each ledge includes a plurality of abutments, each of the plurality of abutments being configured to provide a single point contact between the ledge and the stop.

8. The invention as defined in claim 7 wherein each of the plurality of abutments has sloping sides defining a sharp point for providing the single point contact with the stop.

* * * * *